US006174098B1

(12) United States Patent
Yeh

(10) Patent No.: US 6,174,098 B1
(45) Date of Patent: Jan. 16, 2001

(54) PEN STEM STRUCTURE WITH A DECORATION

(76) Inventor: Teng-Tsung Yeh, No. 13 Ching-Jen Rd., Tu-Cheng (TW)

( * ) Notice: Under 35 U.S.C. 154(b), the term of this patent shall be extended for 0 days.

(21) Appl. No.: 09/461,750

(22) Filed: Dec. 16, 1999

(51) Int. Cl.[7] ..... B43K 29/00

(52) U.S. Cl. ..... 401/52; 401/192; 401/195; 40/334

(58) Field of Search ..... 40/406, 334; 401/52, 401/195, 243, 244, 245, 246, 247, 192, 194; 446/267

(56) References Cited

U.S. PATENT DOCUMENTS

| | | | | |
|---|---|---|---|---|
| 2,237,883 | * | 4/1941 | Lipic | 40/334 |
| 2,264,194 | * | 11/1941 | Wuestman | 40/334 |
| 2,304,522 | * | 12/1942 | Wuestman | 40/334 |
| 2,502,328 | * | 3/1950 | Kuhn | 40/334 |
| 2,591,874 | * | 4/1952 | Ritchie | 40/334 |
| 2,745,198 | * | 5/1956 | Nelson | 40/334 |
| 4,034,493 | * | 7/1977 | Ball | 40/406 |
| 4,085,533 | * | 4/1978 | Ewald | 40/406 |
| 4,395,835 | * | 8/1983 | Schneider | 40/406 |

FOREIGN PATENT DOCUMENTS

| | | | | |
|---|---|---|---|---|
| 1658418 | * | 6/1954 | (AU) | 401/192 |

* cited by examiner

*Primary Examiner*—Henry J. Recla
*Assistant Examiner*—Peter deVore
(74) *Attorney, Agent, or Firm*—Bacon & Thomas, PLLC

(57) ABSTRACT

A pen stem structure with a decoration, including a pen stem and a transparent rod body connected with one end of the pen stem. The rod body defines a close space in which a water soluble solvent and an oily color solvent are contained. The solvents are insoluble in each other. When shaking the pen during writing, the oily color solvent is isolated from the water soluble solvent and buoys in the water soluble solvent to form various patterns so as to achieve a visually entertaining effect.

5 Claims, 6 Drawing Sheets

PEN STEM STRUCTURE WITH A DECORATION

BACKGROUND OF THE INVENTION

The present invention relates to a pen stem structure with a decoration, including a pen stem and a transparent rod body connected with one end of the pen stem. The rod body defines a close space in which a water soluble solvent and an oily color solvent are contained. The solvents are insoluble in each other, so that when shaking the pen during writing, the oily color solvent is isolated from the water soluble solvent and buoys therein to form various patterns.

Many types of pens are commercially available. These pens are designed with various patterns and curves to achieve a better appearance and facilitate holding and writing. However, the conventional pens still lack novel characteristics for expediting desire of purchase.

SUMMARY OF THE INVENTION

It is therefore a primary object of the present invention to provide a pen with a decoration which is able to achieve a visually entertaining effect. The pen stem of the pen includes a transparent rod body connected with one end of the pen stem. The rod body defines a close space in which a water soluble solvent and an oily color solvent are contained. The solvents are insoluble in each other. When shaking the pen during writing, the oily color solvent is isolated from the water soluble solvent and buoys in the water soluble solvent to form various irregular patterns so as to achieve a visually entertaining effect.

The present invention can be best understood through the following description and accompanying drawings, wherein:

BRIEF DESCRIPTION OF THE DRAWINGS

FIG. 6-1 shows another embodiment of the present invention; and

FIG. 6-2 is a sectional view according to FIG. 6-1.

DETAILED DESCRIPTION OF THE PREFERRED EMBODIMENTS

Figure 1:
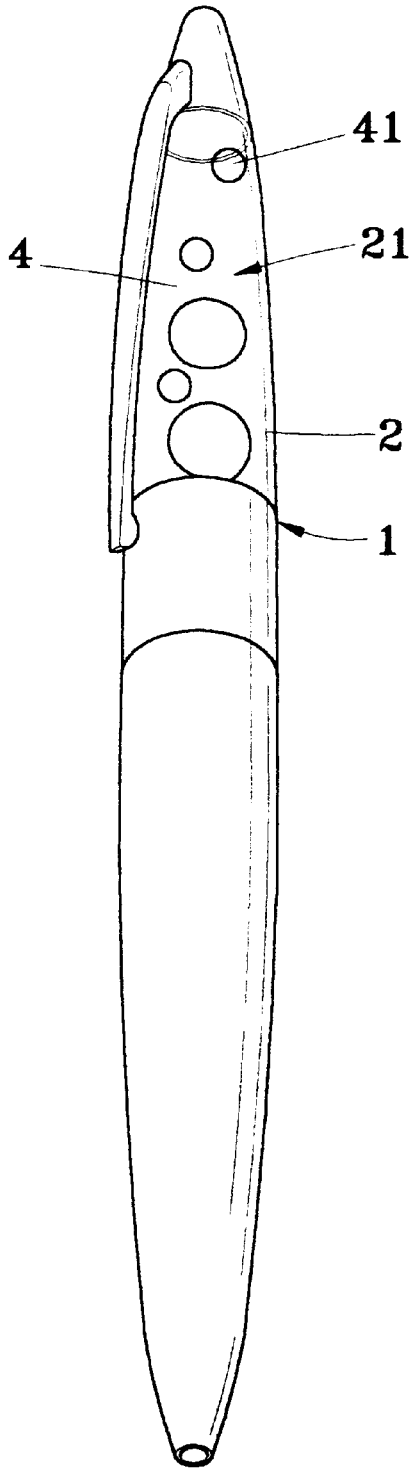
FIG. 1 is a perspective assembled view of the present invention.
Figure 2:
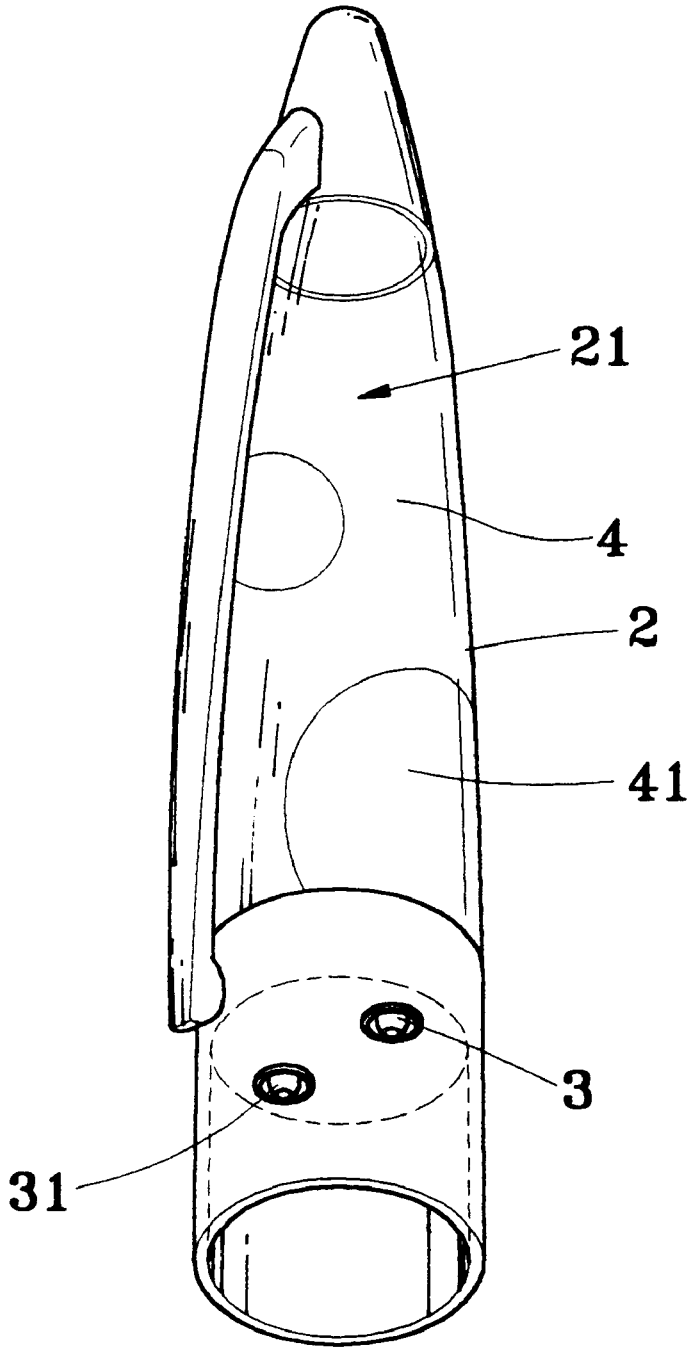
FIG. 2 is a perspective view of the transparent ro body of the present invention.

Please refer to FIGS. 1 and 2. The present invention includes a pen stem 1 and a transparent rod body 2 connected with an upper end of the pen stem 1. The rod body 2 defines a close space 21 in which a water soluble solvent 4 and an oily color solvent 41 are contained. The two kinds of solvents are insoluble in each other. When shaking the pen during writing, the oily color solvent 41 is isolated from the water soluble solvent 4 and buoys therein to form various patterns. A lower end of the rod body 2 is formed with a filling hole 3 and an air exhaustion hole 31 communicating with the close space 21. The water soluble solvent 4 and the oily color solvent 41 are filled into the rod body 2 through the filling hole 3. When filled, the air is exhausted from the exhaustion hole 31 to vacuumize the close space 21.

Figure 3:
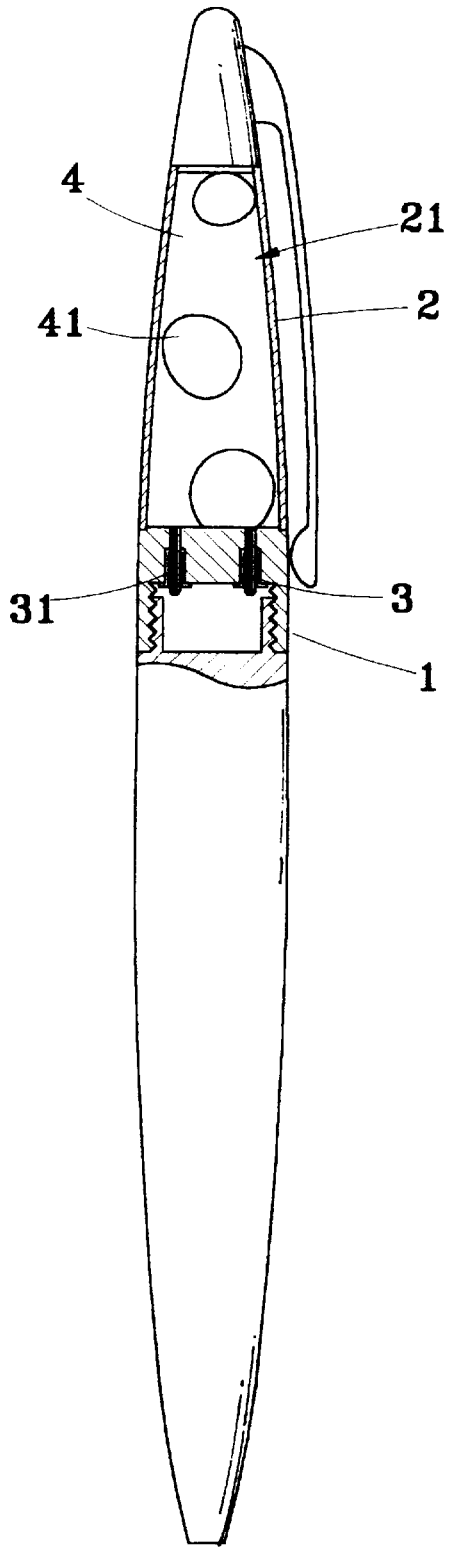
FIG. 3 is a partially sectional view of the present invention.
Figure 4:
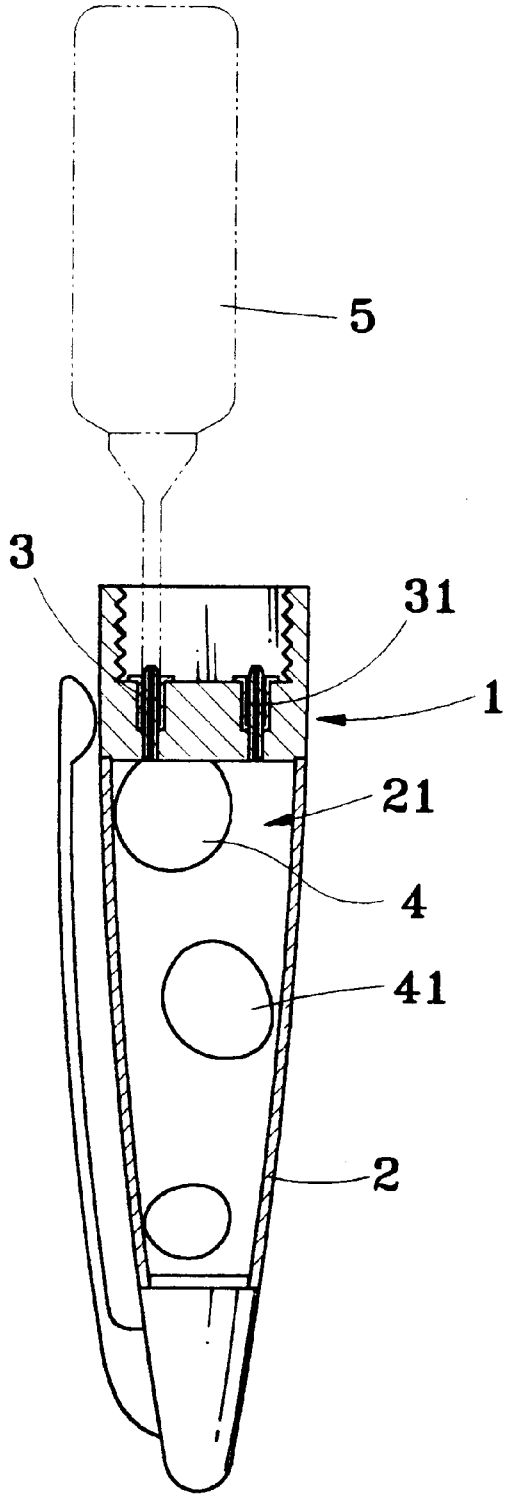
FIG. 4 shows the filling operation of the present invention.

Please refer to FIGS. 3 and 4. When filling the solvent into the close space 21, a filler 5 is tightly pressed against the filling hole 3 and compressed so as to fill the solvent into the space 21. At this time, the air contained in the close space 21 is exhausted to achieve a vacuum state without bubble.

Figure 5:
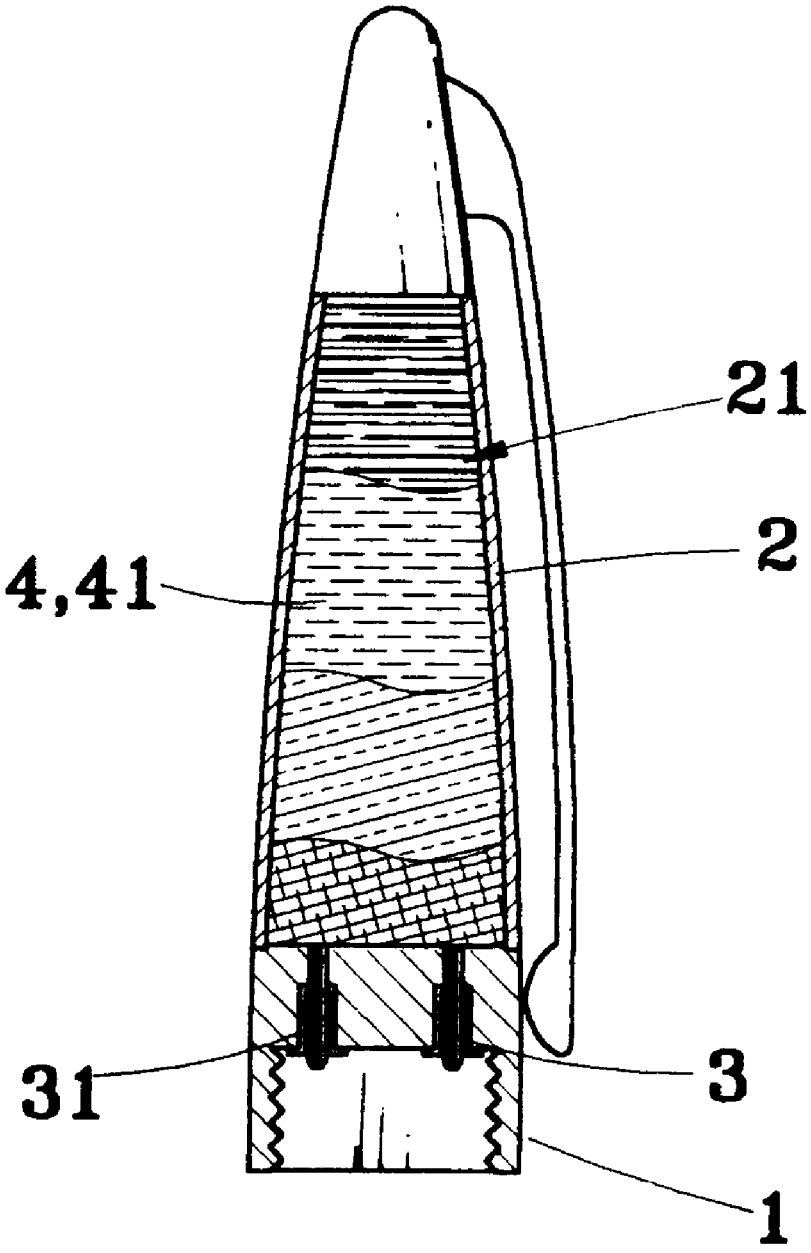
FIG. 5 shows another aspect of the transparent rod body of the present invention.

FIG. 5 shows another aspect of the present invention, in which the densities of the water soluble solvent 4 and the oily color solvent 41 are different from each other so that the solvents will form separate layers of colors so as to achieve a visually entertaining effect.

Figures 1, 6:
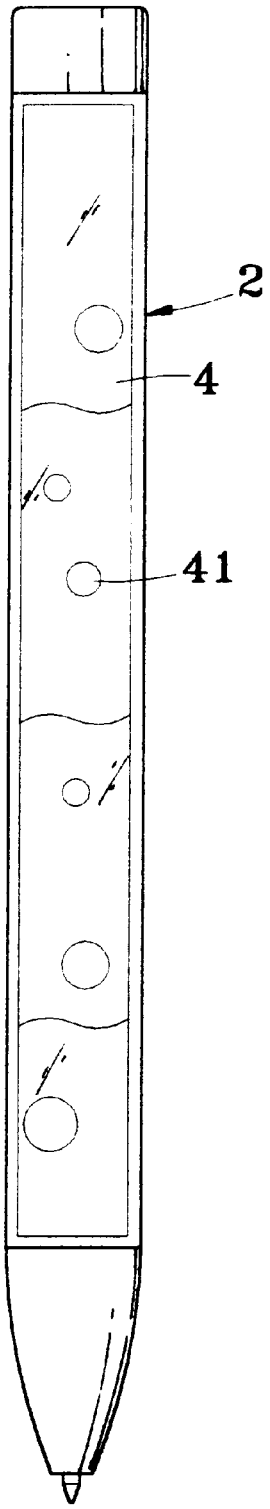
Figures 2, 6:
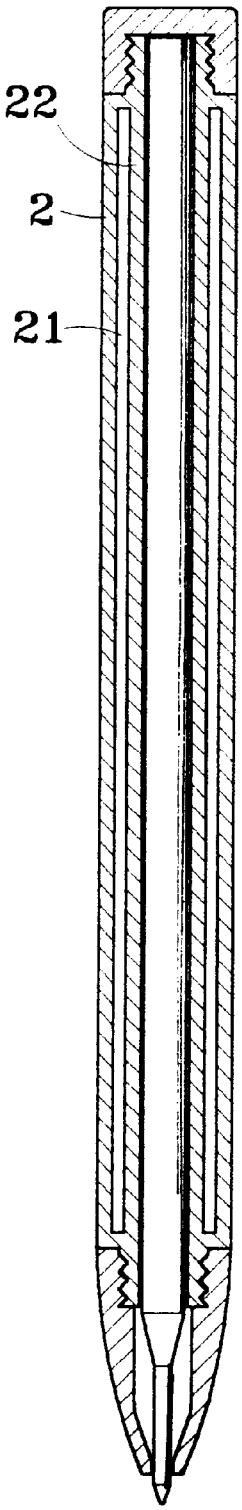

FIGS. 6-1 and 6-2 show another embodiment of the present invention, in which the transparent rod body 2 serves as the stem of the pen and is formed with an inner annular wall 22 and an outer wall. The inner wall and outer wall define therebetween a close space 21 for containing water soluble solvent 4 and the oily color solvent 41. During writing, the solvents flow to form various patterns in the close space 21 to achieve a visually entertaining effect.

It is to be understood that the above description and drawings are only used for illustrating some embodiments of the present invention, not intended to limit the scope thereof. Any variation and derivation from the above description and drawings should be included in the scope of the present invention.

What is claimed is:

1. A pen stem structure with a decoration, comprising a pen stem and a transparent rod body connected with one end of the pen stem, the rod body defining a close space in which a water soluble solvent and an oily color solvent are contained, the two kinds of solvents being insoluble in each other, whereby when shaking the pen during writing, the oily color solvent is isolated from the water soluble solvent and buoys in the water solubler solvent to form various patterns, a lower end of the rod body being formed with a filling hole and an air exhaustion hole communicating with the close space, the water soluble solvent and the oily color solvent being filled into the rod body through the filling hole and when filled, the air is exhausted from the exhaustion hole to achieve a vaccum state without bubble.

2. A pen stem structure as claimed in claim 1, wherein multiple oily solvents with different colors are contained in the close space.

3. A pen stem structure as claimed in claim 2, wherein multiple oily solvents with different specific weights are contained in the close space.

4. A pen stem structure as claimed in claim 2, wherein the multiple oily solvents with different colors are insoluble in each other.

5. A pen stem structure as claimed in claim 1, wherein the oily solvents can be replaced by bright plate materials or other materials insoluble in water to achieve visually entertaining effect.

* * * * *